United States Patent [19]

Binstock et al.

[11] 4,455,836

[45] Jun. 26, 1984

[54] TURBINE HIGH PRESSURE BYPASS TEMPERATURE CONTROL SYSTEM AND METHOD

[75] Inventors: Morton H. Binstock, Pittsburgh, Pa.; Thomas H. McCloskey, Palo Alto, Calif.; Leaman B. Podolsky, Wilmington, Del.

[73] Assignee: Westinghouse Electric Corp., Pittsburgh, Pa.

[21] Appl. No.: 305,814

[22] Filed: Sep. 25, 1981

[51] Int. Cl.[3] ..... F01K 7/22

[52] U.S. Cl. ..... 60/663; 60/653; 60/680

[58] Field of Search ..... 60/646, 653, 657, 660, 60/663, 679, 680

[56] References Cited

U.S. PATENT DOCUMENTS

| | | | |
|---|---|---|---|
| 2,747,373 | 5/1956 | Eggenberger et al. | 60/663 X |
| 3,055,181 | 9/1962 | Argersinger et al. | 60/663 X |
| 4,132,076 | 1/1979 | Weiss | 60/663 X |
| 4,274,259 | 6/1981 | Silvestri, Jr. | 60/653 X |
| 4,372,125 | 2/1983 | Dickenson | 60/653 X |

*Primary Examiner*—Allen M. Ostrager
*Assistant Examiner*—Stephen F. Husar
*Attorney, Agent, or Firm*—D. Schron

[57] ABSTRACT

A bypass system for a steam turbine wherein the temperature of the steam bypassed around the high pressure turbine is accurately controlled by measuring the inlet and outlet temperatures of the boiler reheater and generating an adaptive set point. The set point value is used to govern operation of a spray valve which admits cooling water to the bypass steam path.

22 Claims, 12 Drawing Figures

TURBINE HIGH PRESSURE BYPASS TEMPERATURE CONTROL SYSTEM AND METHOD

CROSS REFERENCE TO RELATED APPLICATIONS

Ser. No. 305813 entitled "Turbine High Pressure Bypass Pressure Control System" by M. H. Binstock, L. B. Podolsky and T. H. McClosky, filed concurrently herewith and assigned to the same assignee as the present invention.

BACKGROUND OF THE INVENTION

1. Field of the Invention

The invention in general relates to steam turbine bypass systems, and more particularly to a control arrangement for regulating certain temperatures in the high pressure portion of the system.

2. Description of the Prior Art

In the operation of a steam turbine power plant, a boiler produces steam which is provided to a high pressure turbine section through a plurality of steam admission valves. Steam exiting the high pressure turbine section is reheated, in a conventional reheater, prior to being supplied to an intermediate pressure turbine section (if included) and thereafter to a low pressure turbine section, the exhaust from which is conducted into a condenser where the exhaust steam is converted to water and supplied to the boiler to complete the cycle.

The regulation of the steam through the high pressure turbine section is governed by the positioning of the steam admission valves and as the steam expands through the turbine sections, work is extracted and utilized by an electrical generator for producing electricity.

A conventional fossil fueled steam generator, or boiler, cannot be shut down instantaneously. If, while the turbine is operating, a load rejection occurs necessitating a turbine trip (shutdown), steam would normally still be produced by the boiler to an extent where the pressure increase would cause operation of various safety valves. In view of the fact that the steam in the system is processed to maintain a steam purity in the range of parts per billion, the discharging of the process steam can represent a significant economic waste.

Another economic consideration in the operation of a steam turbine system is fuel costs. Due to high fuel costs, some turbine systems are purposely shut down during periods of low electrical demands (for example, overnight) and a problem is encountered upon a hot restart (the following morning) in that the turbine has remained at a relatively hot temperature whereas the steam supplied upon boiler start-up is at a relatively cooler temperature. If this relatively cool steam is admitted to the turbine, the turbine would experience thermal shock which would significantly shorten its useful life. To obviate this thermal shock the steam must be admitted to the turbine very slowly, thereby forcing the turbine to cool down to the steam temperature, after which load may be picked up gradually. This process is not only lengthy, it is also costly.

As a solution to the load rejection and hot restart problems, bypass systems are provided in order to enhance process on-line availability, obtain quick restarts, and minimize turbine thermal cycle expenditures. Very basically, in a bypass operation, the steam admission valves to the turbine may be closed while still allowing steam to be produced by the boiler. A high pressure bypass valve may be opened to divert the steam (or a portion thereof) around the high pressure turbine section, and provide it to the input of the reheater. A low pressure bypass valve allows steam exiting from the reheater to be diverted around the intermediate and low pressure turbine sections and be provided directly to the condenser.

Normally the turbine extracts heat from the steam and converts it to mechanical energy, whereas during a bypass operation, the turbine does not extract the heat from the bypassed steam. Since the elevated temperature of the steam would damage the reheater and condenser, relatively cold water is injected into the high and low pressure bypass steam paths so as to prevent overheating of the reheater and condenser. The amount of spray water injected into the high pressure bypass steam path is governed by a temperature control system. In prior art temperature control systems, a controller samples the temperature at the input of the reheater, and compares it against a fixed reference or setpoint, the determination of which requires a great deal of time and much effort. Various trial runs must be made on the boiler system and the setpoint determined from these tests is a compromised value and not necessarily optimum for all operating conditions.

The present invention provides a significantly improved high pressure bypass temperature control system thereby minimizing the thermal stresses to the turbine and boiler.

SUMMARY OF THE INVENTION

High pressure bypass control apparatus is provided for a steam turbine system having a steam generator, a high pressure turbine, at least one lower pressure turbine, a reheater in the steam flow path between the high and low pressure turbines, and a steam bypass path for bypassing the turbines. The apparatus includes a high pressure bypass valve with means for activating this valve in response to certain predetermined pressure conditions present in the system. A high pressure spray valve is provided for admitting cooling spray to the bypass steam when the high pressure bypass valve is activated. As opposed to providing a fixed temperature setpoint, means are provided for adaptively regulating the temperature of the steam passed by the high pressure bypass valve as a function of both the reheater input and output temperatures. A further improvement in the steam temperature regulation is accomplished by a control system which is both fast acting under certain predetermined conditions so as to provide a "coarse", but quick control and slow acting under other predetermined conditions so as to provide a "fine tuned", but slower control action.

BRIEF DESCRIPTION OF THE DRAWINGS

Similar reference characters refer to similar parts throughout the figures.

DESCRIPTION OF THE PREFERRED EMBODIMENT

Figure 1:
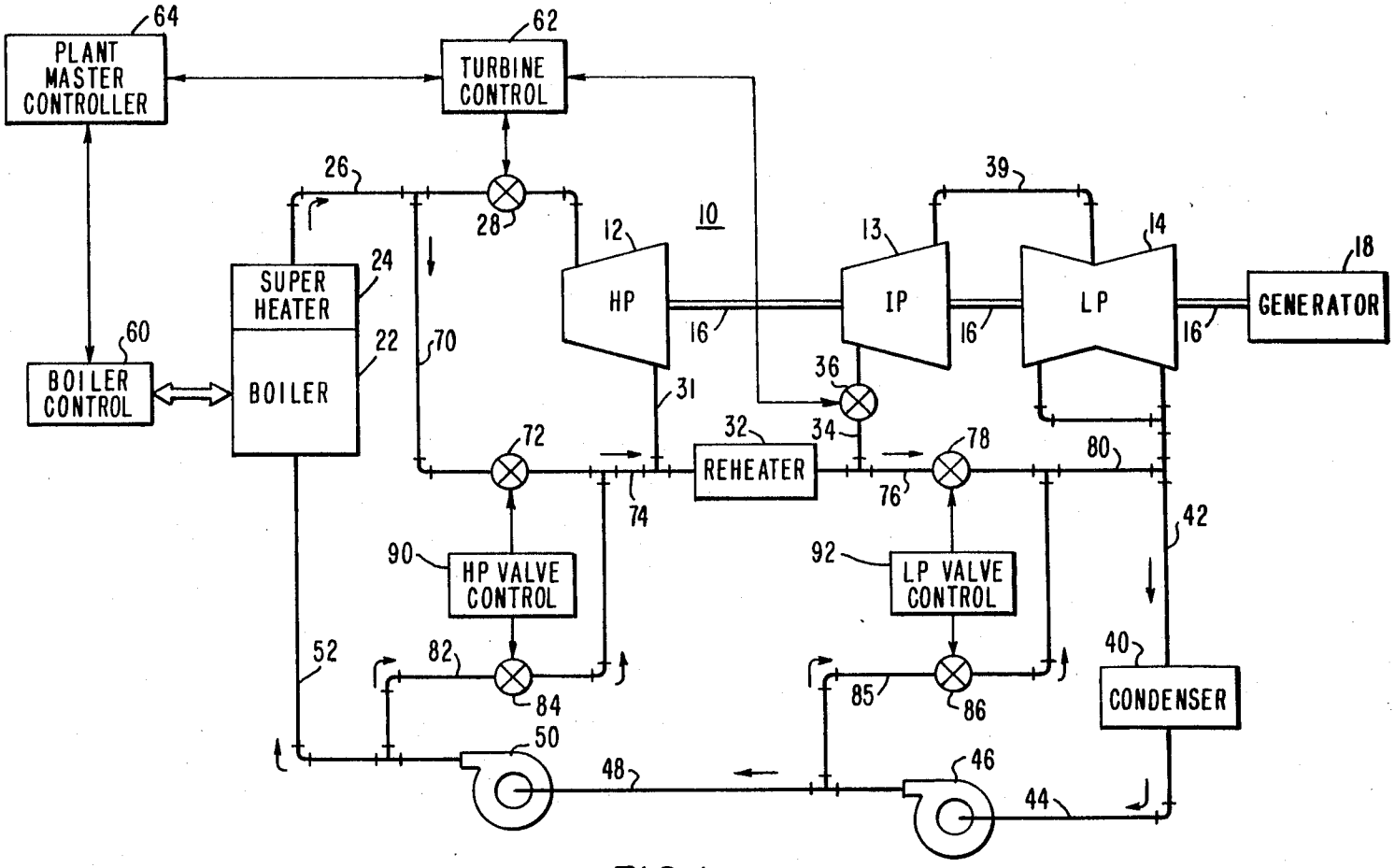
FIG. 1 is a simplified block diagram of a steam turbine generator power plant which includes a bypass system.

FIG. 1 illustrates by way of example a simplified block diagram of a fossil fired single reheat turbine generator unit. In a typical steam turbine generator power plant such as illustrated in FIG. 1, the turbine system 10 includes a plurality of turbine sections in the form of a high pressure (HP) turbine 12, an intermediate pressure (IP) turbine 13 and a low pressure (LP) turbine 14. The turbines are connected to a common shaft 16 to drive an electrical generator 18 which supplies power to a load (not illustrated).

A steam generating system such as a conventional drum-type boiler 22 operated by fossil fuel, generates steam which is heated to proper operating temperatures by superheater 24 and conducted through a throttle header 26 to the high pressure turbine 12, the flow of steam being governed by a set of steam admission valves 28. Although not illustrated, other arrangements may include other types of boilers, such as super and subcritical once-through types, by way of example.

Steam exiting the high pressure turbine 12 via steam line 31 is conducted to a reheater 32 (which generally is in heat transfer relationship with boiler 22) and thereafter provided via steam line 34 to the intermediate pressure turbine 13 under control of valving arrangement 36. Thereafter, steam is conducted, via steam line 39, to the low pressure turbine 14, the exhaust from which is provided to condenser 40 via steam line 42 and converted to water. The water is provided back to the boiler 22 via the path including water line 44, pump 46, water line 48, pump 50, and water line 52. Although not illustrated, water treatment equipment is generally provided in the return line so as to maintain a precise chemical balance and a high degree of purity of the water.

Operation of the boiler 22 normally is governed by a boiler control unit 60 and the turbine valving arrangements 28 and 36 are governed by a turbine control unit 62 with both the boiler and turbine control units 60 and 62 being in communication with a plant master controller 64.

In order to enhance on-line availability, optimize hot restarts, and prolong the life of the boiler condenser and turbine system, there is provided a turbine bypass arrangement whereby steam from boiler 22 may continually be produced as though it were being used by the turbines, but in actuality bypassing them. The bypass path includes steam line 70, with initiation of high pressure bypass operation being effected by actuation of high pressure bypass valve 72. Steam passed by this valve is conducted via steam line 74 to the input of reheater 32 and flow of the reheated steam in steam line 76 is governed by a low pressure bypass valve 78 which passes the steam to steam line 42 via steam line 80.

In order to compensate for the loss of heat extraction normally provided by the high pressure turbine 12 and to prevent overheating of the reheater 32, relatively cool water in water line 82, provided by pump 50, is provided to steam line 74 under control of high pressure spray valve 84. Other arrangements may include the introduction of the cooling fluid directly into the valve structure itself. In a similar fashion, relatively cool water in water line 85 from pump 46 is utilized to cool the steam in steam line 80 to compensate for the loss of heat extraction normally provided by the intermediate and low pressure turbines 13 and 14 and to prevent overheating of condenser 40. A low pressure spray valve 86 is provided to control the flow of this spray water, and control means are provided for governing operation of all of the valves of the bypass system. More particularly, a high pressure valve control 90 is provided and includes a first circuit arrangement for governing operation of high pressure bypass valve 72 and a second circuit arrangement for governing operation of high pressure spray valve 84. Similarly, a low pressure valve control 92 is provided for governing operation of low pressure bypass valve 78 and low pressure spray valve 86. An improved low pressure bypass spray valve control system is described and claimed in copending application Ser. No. 321,160 filed Nov. 13, 1981 and assigned to the same assignee as the present invention.

Figure 2:
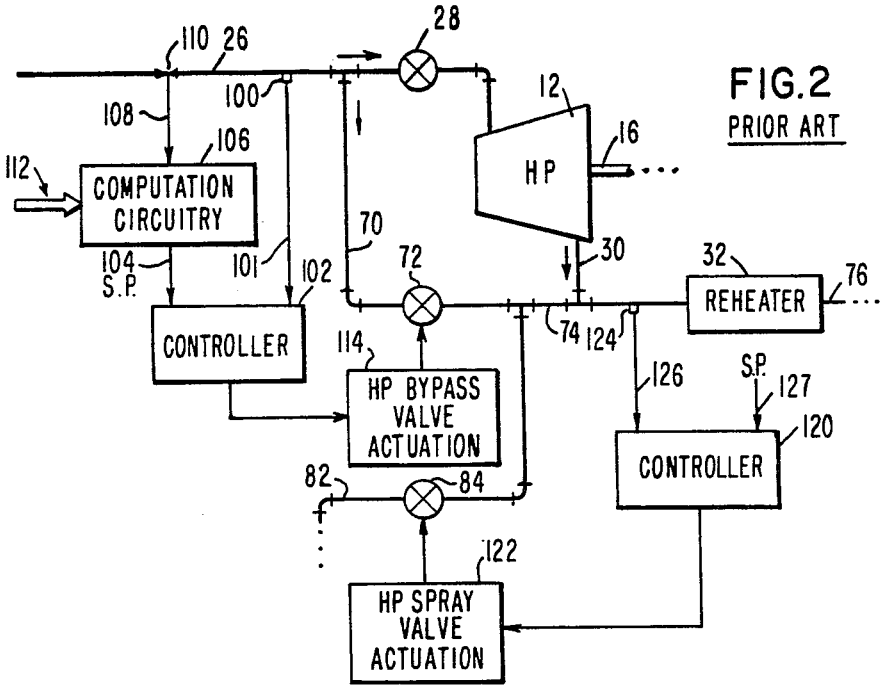
FIG. 2 PRIOR ART
FIG. 2 illustrates a portion of FIG. 1 in more detail to illustrate a typical prior art bypass control arrangement.

A typical prior art high pressure control arrangement is illustrated in FIG. 2 which duplicates a portion of FIG. 1 together with a prior art control in somewhat more detail.

Initiation of bypass action is obtained by comparing actual throttle pressure with a throttle pressure setpoint, with the deviation between these two signals being operable to generate a control signal for the high pressure bypass valve. More particularly, a pressure transducer 100 in the steam path generates a signal proportional to actual throttle pressure and provides this signal, on line 101, to a controller circuit 102. The actual throttle pressure signal on line 101 is compared with a throttle pressure setpoint signal on line 104 derived and provided by computation circuitry 106. One input to computation circuitry 106 is a signal on line 108 indicative of steam flow with this signal being derived by examining the pressure considerations at restriction 110 in the steam line. The flow indication is modified by various factors and maximum and minimum allowable pressure values as well are involved in the derivation of the setpoint value. These modification factors are provided to the computation circuitry as indicated by the heavy arrow 112.

In response to deviation between the two input signals to controller 102, a control signal is thereby provided to the high pressure valve actuation circuit 114 for governing the movement of high pressure bypass valve 72. With this type of arrangement, the throttle pressure setpoint is dependent upon the steam flow. As the load changes, the steam flow changes as does the setpoint. Operation of the bypass or turbine may result in a change of steam flow, which in turn will affect the throttle pressure setpoint, which in turn, in a reiterative fashion, will reaffect the turbine or bypass systems.

With respect to operation of the high pressure spray valve 84, a controller 120 is responsive to the actual temperature at the input of reheater 32 as compared with a temperature setpoint to provide a control signal to the high pressure spray valve actuation circuit 122 so as to govern the cooling spray operation.

The reheater input temperature, generally known as the cold reheat temperature, is derived by means of a temperature transducer 124 which provides a signal on line 126 as one input to controller 120. The other input, on line 127, is a setpoint temperature derived for example from a turbine master controller.

The setpoint calculation involves the expenditure of considerable time and effort and at best represents an empirically derived compromised value, which is not necessarily optimum for all operating conditions. In contrast, the present invention provides for an adaptive setpoint derived as a function of certain system parameters for improved temperature control, and to this end, reference is made to the control means illustrated in FIG. 3.

Figure 3:
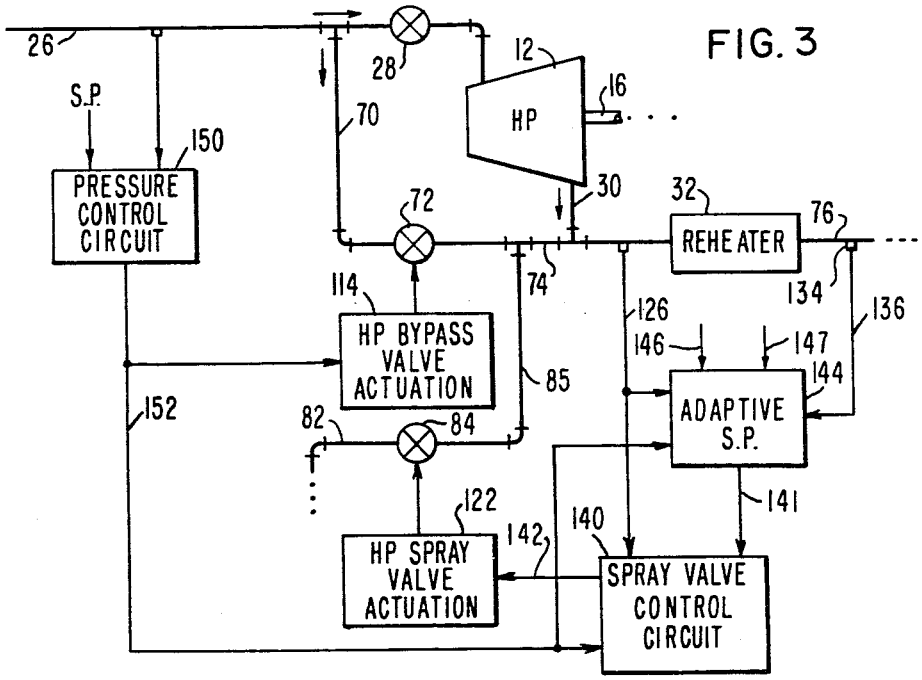
FIG. 3 is a block diagram illustrating an embodiment of the present invention.

In addition to the temperature transducer 124 which provides a cold reheat temperature signal on line 126, the arrangement of FIG. 3 additionally includes a temperature transducer 134 positioned at the output of reheater 32 for providing a temperature signal on line 136 indicative of hot reheat temperature. A spray valve control circuit 140 is responsive to the cold reheat temperature signal on line 126 and a setpoint signal on line 141 for governing the cold reheat temperature by controlling operation of spray valve 84 by means of a control signal on line 142 to the high pressure spray valve actuation circuit 122 which may, as well as the other valve activation circuits described herein, be of the common electro-hydraulic, electro-mechanical or electric motor variety, by way of example.

As contrasted with the prior art, the setpoint signal on line 141 is not a precalculated set valve but is adaptive to system conditions and generated by an adaptive setpoint circuit 144.

Adaptive setpoint circuit 144, in addition to being responsive to the cold and hot reheat temperature signals on lines 126 and 136, respectively, may also be made responsive to external signals, to be described, on lines 146 and 147.

Activation of the spray valve control arrangement is made in response to certain pressure conditions, and for this purpose a pressure control circuit 150 is provided. Although not limited thereto, pressure control circuit 150 is preferably of the type to be described subsequently with respect to FIG. 6. Basically, when the system goes on bypass operation, an output signal on line 152 is provided by pressure control circuit 150 so as to initiate the temperature control operation. A more detailed description of this operation may be understood with further reference to FIG. 4.

ADAPTIVE SETPOINT CIRCUIT 144

The adaptive setpoint circuit 144 includes a proportional plus integral (PI) controller 160 which receives the hot reheat temperature signal on line 136 as one input and a signal on line 162 provided by summing circuit 164, as a second input. Since PI controllers are also used in the spray valve control circuit 140, a brief explanation of their basic operation will be given with respect to FIG. 5 to which reference is now made.

The PI controller receives two input signals on respective inputs A and B, takes the difference between these two signals, applies some gain K to the difference to derive a signal which is added to the integral of the signal, resulting in a control signal at the output C. The control circuit of FIG. 5 additionally includes a high/-low limit section which will limit the output signal to some maximum value in accordance with the value of a high limit signal applied at lead D and will limit the output signal to some minimum value in accordance with the value of a low limit signal applied at lead E. Alternatively, high and low limits may be selected by circuitry internal to the controller. If a zero voltage signal is placed on lead D, the output signal will be clamped at zero volts. A proper output control signal may subsequently be provided if lead D is provided with an adequate higher valued signal, which would thus function as a controller enable signal.

The controller also operates in a second mode of operation wherein a desired signal to be tracked is supplied to the controller at lead F and appears at the output C if a track enabling signal is provided at lead G. In such instance, the proportional plus integral operation on the difference between the two signals at inputs A and B is decoupled from the output. Such PI controller finds extensive use in the control field and one operative embodiment is a commercially available item from Westinghouse Electric Corporation under their designation 7300 Series Controller, Style G06. The PI function may also be implemented, if desired, by a microprocessor or other type of computer.

Figure 4:
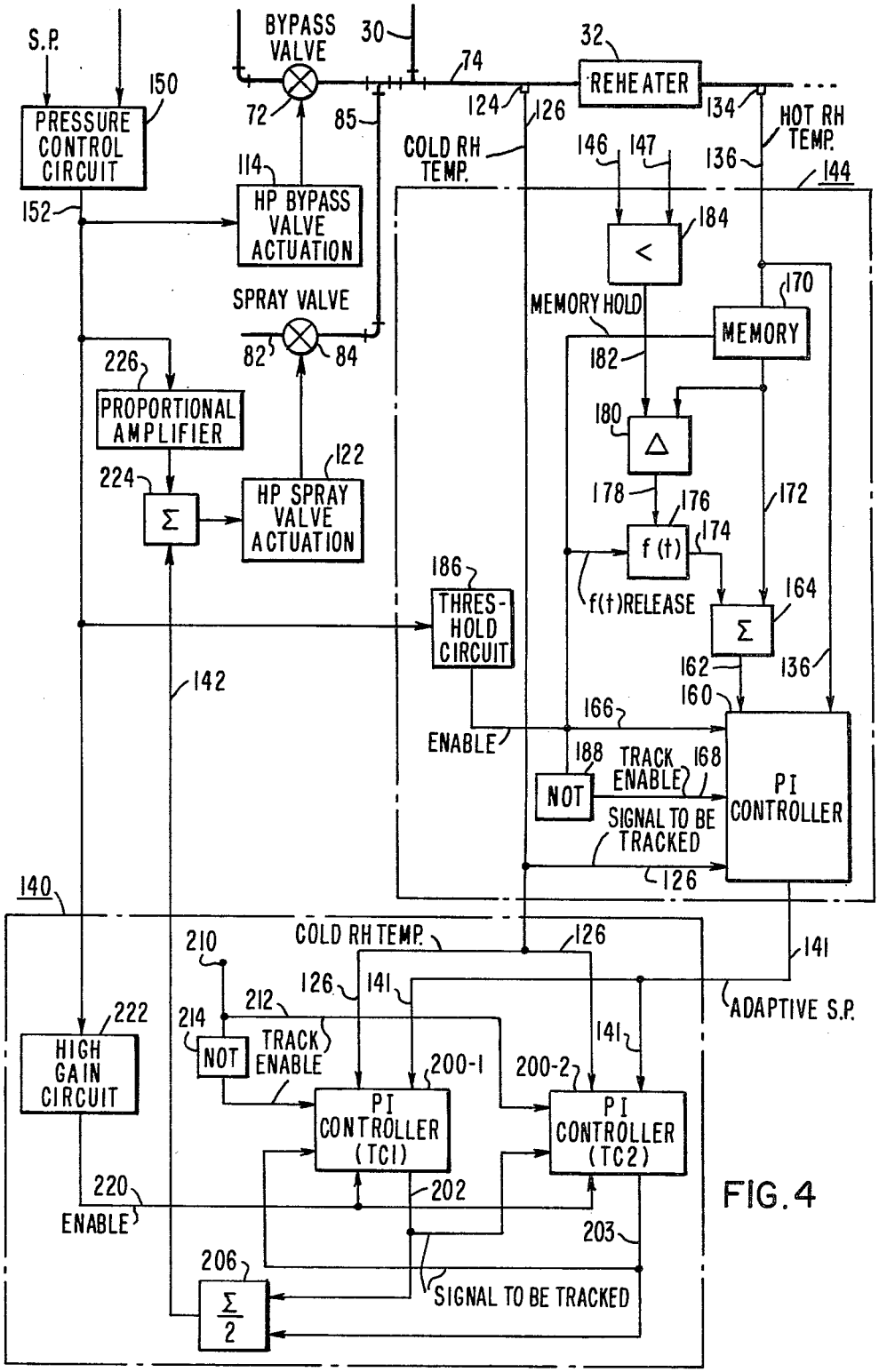
FIG. 4 is a block diagram further detailing the arrangement of FIG. 3.
Figure 5:
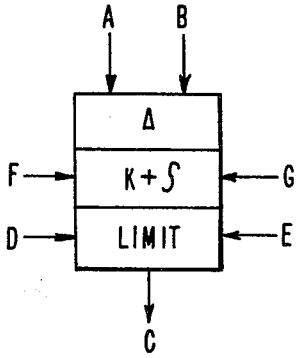
FIG. 5 functionally illustrates a typical controller of FIG. 4.

Returning once again to FIG. 4, lines 136 and 162 of controller 160 constitute the first and second inputs A and B of FIG. 5, line 141 constitutes the output C, line 166 functions as the external limits line D, line 168 is the track enable line G, and the signal to be tracked appears on line 126 corresponding to line F of FIG. 5.

Adaptive setpoint circuit 144 additionally includes memory means such as memory 170 operable to memorize the hot reheat temperature when the system goes into a bypass operation. The memorized hot reheat temperature value is provided, on line 172, as one input to summing circuit 164, the other input of which on line 174 is derived from function of time circuit 176 operable to gradually ramp any input signal on line 178 from difference circuit 180. Difference circuit 180 provides an output signal which is the difference between the memorized hot reheat temperature signal from line 172 and the signal on line 182 which is the lower valued signal from line 146 or line 147 selected by the low value signal selector 184.

A threshold type device 186 is responsive to the output signal on line 152 from the pressure control circuit 150 to provide an enable signal upon bypass operation so as to: (a) instruct the memory 170 to hold the hot reheat temperature value; (b) release the function of time circuit 176 for operation; and (c) enable controller 160. In the absence of an enabling signal from threshold device 186, NOT circuit 188 provides, on line 168, a track enabling signal and in the presence of an output signal from threshold device 186, the track enabling signal will be removed.

OPERATION OF ADAPTIVE SETPOINT CIRCUIT 144

Let it be assumed for purposes of illustration that at some point in the operation of the steam turbine, a turbine trip occurs necessitating the closing of the steam admission valves and an initiation of bypass operation. Let it further be assumed by way of example that the cold reheat temperature is 900° (all temperatures given in Farenheit degrees) and due to the heat gain imparted by reheater 32, the hot reheat temperature is 1000°.

With the initiation of bypass operation, a signal on line 152 from pressure controller 150 causes threshold device 186 to provide its enabling signal so that memory 170 stores the hot reheat temperature of 1000°. Prior to bypass operation, the controller 160 was tracking the cold reheat temperature on line 126 so that the output signal on line 141 represents the cold reheat temperature and will remain such until the inputs to controller 160 are changed. In this respect therefore, controller 160 acts as a memory for the cold reheat temperature. At this point the actual cold reheat temperature signal on line 126 and the adaptive setpoint signal on line 141 are identical and accordingly no output signal is provided by spray valve control circuit 140, the operation of which will be described hereinafter.

The input signal on line 136 to controller 160 is the actual hot reheat temperature. Controller 160 additionally receives an input signal on line 162 from summing circuit 164. The output of the function of time circuit 176 does not change instantaneously upon bypass operation and, accordingly, summing circuit 164 provides an output signal equal to its input signal on line 172, that is, the memorized hot reheat temperature.

Neglecting the operation of circuits 176, 180 and 184 for the time being, it is seen that the inputs on lines 136 and 162 to controller 160 are identical so that no change occurs in its output signal and the adaptive setpoint value remains where it was prior to bypass operation. If the turbine now goes back into operation, the temperatures would be as they were just prior to the turbine trip and normal operation will be continued. Suppose, however, that due to some circumstance, the hot or cold reheat temperatures should vary somewhat. For example the gain of the reheater 32 may change. If the cold reheat temperature changes, it no longer matches the previously memorized value on line 141, and accordingly the unbalance will cause spray valve control circuit 140 to operate to effect a correction. If the hot reheat temperature changes, the input on line 136 to controller 160 changes and it no longer is equivalent to the previously memorized hot reheat temperature on line 162 and, accordingly, controller 160 will vary the adaptive setpoint signal causing an unbalance of the input signals to spray valve control circuit 140 and a consequent corrective action therefrom. The corrective action will be such so as to change the cold reheat temperature so as to maintain the hot reheat temperature at the previously memorized value.

As a further example, a situation will be considered wherein bypass operation is initiated at a point in time when the hot reheat temperature is, for example, 980°, but wherein 1000° is actually desired for better thermal efficiency. In such instance, the 1000° desired signal value may be provided on line 147 and may be supplied by turbine control unit 62 (FIG. 1) automatically or by operator intervention. At this point, the signal on line 146 is also run up to its maximum value, which may be indicative of a desired temperature of 1000°, so that the low value signal selector circuit 184 outputs a signal on line 182 indicative of a desired 1000° temperature. In the example under consideration, a hot reheat temperature of 980° was memorized upon initiation of bypass operation and this 980° signal on output line 172 in addition to being provided to summation circuit 164 is also provided to the difference circuit 180 so that a difference signal indicative of 20° (1000°–980°) is provided to the function of time circuit 176 at its input on line 178. Since this latter circuit is released for operation, it will slowly provide an increasing output signal on line 174 to summation circuit 164 where it is added to the previously memorized 980° value signal on line 172. Since thermal stresses are to be avoided, this signal on line 162 is increased at a very slow value so that the adaptive setpoint on line 141 changes at a very slow value to initiate corrective action to increase the cold reheat temperature to a point where the hot reheat temperature equals the desired 1000° value.

Accordingly, two examples of temperature control have been described. Both occurred during normal operation of the turbine with the first example illustrating the maintenance of the same temperature conditions and the second illustrating the ramping to a new temperature as dictated by a temperature setpoint on line 147 from the turbine control unit 62. A third situation will be considered wherein a hot restart is to be made.

Let it be assumed that the turbine system has been shut down for the night (although the turbine is rotated very slowly on turning gear to prevent rotor distortion) and that it is to be restarted the following morning. In the morning the boiler will have cooled down to a relatively low temperature whereas the turbine, due to its massive metal structure, will have cooled down, but to a relatively hotter temperature than the boiler. By way of example, in the morning the hot reheat temperature may be 600° whereas the metal temperature of the turbine would dictate steam being introduced at 950°, for example.

In the morning, bypass operation will be initiated and when so initiated, memory circuit 170 will store the 600° hot reheat temperature value and the turbine control unit either automatically or by operator command, can input a setpoint signal of a desired 950° on line 147 of the low value signal selector 184. During this operation, the signal on line 146 is run up to the maximum so that the 950° value is supplied to difference circuit 180 resulting in an output difference signal indicative of 350° applied to the function of time circuit 176. This difference signal causes an increase in the adaptive setpoint value on line 141 to slowly bring up the steam to the proper temperature, after which the steam admission valves may be opened so as to bring the turbine up to rated speed, during which time the setpoint signal on line 147 may be further increased to a desired value of 1000°, the normal operating temperature.

Under certain operating conditions, it may be necessary or desirable to modify the hot reheat temperature in accordance with certain boiler considerations. Accordingly, a reheat temperature setpoint value may be applied to line 146 of the low value signal selector 184 and this reheat temperature setpoint value may emanate from the boiler control unit 60 (FIG. 1). When not in use, this reheat temperature setpoint signal is run up to, and maintained at, its maximum value, as previously described so that the setpoint signal on line 147 may be selected for control purposes. It is to be noted that this latter signal is maintained at the desired temperature indication and although this temperature indication, in the previous examples, was higher than the actual hot reheat temperature, is to be understood that under various operating circumstances the desired temperature may be lower than actual such that difference circuit 180 will provide a negative value output signal and function of time circuit 176 will provide an output signal which slowly ramps in a negative direction to subtract its value from the memorized hot reheat temperature indication on line 172.

Accordingly, adaptive setpoint circuit 144 provides an adaptive setpoint signal on line 141 during bypass operation so as to maintain the hot reheat temperature at a certain predetermined value either during normal operation or during start-up by controlling the cold reheat temperature through operation of the spray valve circuit 140.

SPRAY VALVE CIRCUIT 140

Spray valve circuit 140 includes dual proportional plus integral controllers, controller 200-1 and controller 200-2, each of which receives the cold reheat temperature signal on line 126 as well as the adaptive setpoint signal on line 141. Only one of the controllers 200-1 or 200-2 will be enabled for control operation at any one time and when so enabled controller 200-1 will provide an appropriate output signal on line 202 and when so enabled controller 200-2 will provide an output signal on line 203. Controllers 200-1 and 200-2 are identical to the controller previously described with respect to FIG. 5. The output signal on line 202 from controller 200-1 is supplied to a summation circuit 206 as is the signal on line 203 from controller 200-2. In addition, the output signal from each controller is fed to the other controller as a signal to be tracked so that each controller will reproduce the other controller's output signal when in a tracking mode.

Although the two controllers are identical to the controller described in FIG. 5, they are designed to have different time constants. That is, when controller 200-1 is selected for operation, it will have an output response as a result of an imbalance in input signals on lines 126 and 141, and this output response is very much quicker than the response of controller 200-2 when it is selected for operation. If the controllers are implemented as analog circuits, the integral circuit portion of controller 200-1 is designed to have a time constant TC1 while controller 200-2 is designed to have a time constant TC2, where TC2 is greater than TC1.

Rather than having a single controller with a single response time for all operational situations, with the present arrangement either controller can be selected depending upon whether or not the system is starting up or is fully operational. Thus, controller 200-1 with its fast time constant is selected for a fully operational situation wherein bypass operation is not in effect and wherein a quick response time to a load shedding situation may be provided, whereas controller 200-2 with a slower response time may be selected for start-up situations.

Selection of which controller tracks while the other responds to the input signals can be accomplished by application of an appropriate signal to terminal 210, such signal being initiated either manually or automatically. The application of a binary signal of a first logical state operates as a track enabling signal on line 212 and, with the presence of NOT circuit 214, the previously provided track enabling signal on line 216 is removed so that controller 200-1 is primed to respond to any quick load shed which causes an unbalance in the input signals on lines 126 and 141, whereas controller 200-2 tracks the output signal on line 202 and replicates it on output line 203. Application of a binary signal of an opposite logical state to terminal 210 will reverse the roles of the controllers such that controller 200-1 tracks the output signal on line 203 from controller 200-2 and replicates it on line 202.

Neither controller however will be operational until provided with an enabling signal on line 220 indicative of a bypass operation wherein pressure controller 150 has provided an output signal on line 152. This latter output signal is provided to a high gain circuit 222 which in turn provides the enabling signal.

OPERATION OF SPRAY VALVE CONTROL CIRCUIT 140

Let it be assumed that bypass operation is initiated such that both controllers 200-1 and 200-2 are enabled for operation. If the bypass operation occurs during start-up, controller 200-2 is controlling and controller 200-1 is tracking whereas if the turbine is fully operational, controller 200-1 is controlling and controller 200-2 is tracking.

If either the cold reheat temperature on line 126 or the adaptive setpoint signal on line 141 changes, as previously discussed, the controller in command will respond to the difference between these two signals, and provide an output signal which is utilized to open or close high pressure spray valve 84 so as to ultimately control the hot reheat temperature by controlling the cold reheat temperature through the spray action on the steam in steam line 74.

Summation circuit 206 is of the type which provides an output signal which is half the sum of its input signals. Suppose that controller 200-2 is responding to a difference in its inputs to provide, on output line 202, a signal of value A. This signal is provided to summation circuit 206 as well as to controller 200-2 which, being in the tracking mode, provides the same signal A on output line 203. Half the sum of the input signals to summation circuit 206 therefore results in an output signal A therefrom on line 142. With this arrangement, the control function may be switched to the other controller while maintaining the same output signal on line 142 to effect a bumpless transfer of control.

Figure 4A:
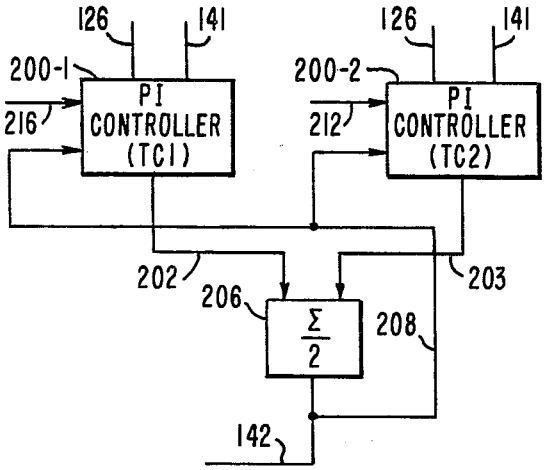
FIG. 4A is a block diagram illustrating an alternative tracking arrangement to that shown in FIG. 4.

As an alternative, and as illustrated in FIG. 4A, the same tracking and bumpless transfer may be accomplished by connecting the output signal from summation circuit 206 to the tracking inputs of the controllers, via line 208.

If desired, initiation of bypass operation may also be utilized to initially open the spray valve 84 to some predetermined position to quickly admit spray water for temperature control. This predetermined position may not be exactly correct for necessary fine temperature control and accordingly, the position is modified by the output of spray valve control circuit 140. For this purpose summation circuit 224 and proportional amplifier 226 are provided. In response to any output signal on line 152 from pressure control circuit 150, the proportional amplifier 226 will provide, to summation circuit 224, an appropriately scaled signal to initiate the gross adjustment of spray valve 84. The output signal on line 142 is also supplied to summation circuit 224 to add to or subtract from the signal provided by amplifier 226 so as to allow for the fine adjustment of spray valve 84 for the precise temperature control herein described.

PRESSURE CONTROL CIRCUIT 150

Figure 6:
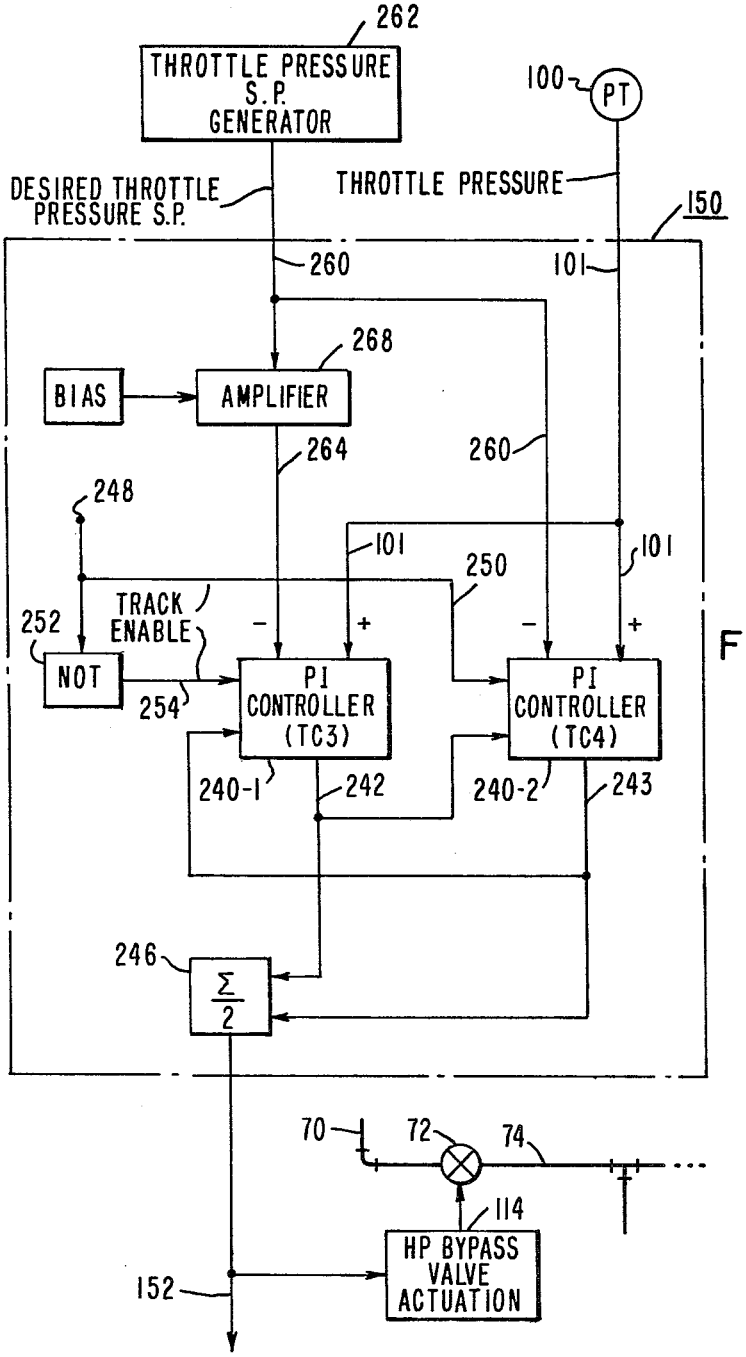
FIG. 6 is a block diagram further detailing the manner in which bypass operation may be initiated.

The high pressure control circuit 150, illustrated in more detail in FIG. 6, is operable to determine when the system is to go on bypass operation and adaptively controls boiler throttle pressure to a desired value and will do so independently of process feedback or interaction. It is to be noted that the boiler throttle pressure is equivalent to the pressure at the input of the bypass system as well as the steam admission valves 28.

The pressure control circuit 150 includes first and second proportional plus integral controllers 240-1 and 240-2 each operable to provide an output signal on respective lines 242 and 243 to summation circuit 246 of the type described in FIG. 4. In addition, as was the case with respect to FIG. 4, the output signal from each controller is fed to the other controller so that each controller will track the other's output signal when in a tracking mode.

The determination of which controller tracks while the other controls is accomplished with the application of an appropriate signal to terminal 248, such signal being initiated either manually or automatically. The application of a binary signal of a first logical state operates as a track enabling signal on line 250 while the application of a binary signal of an opposite logical state will, due to the presence of NOT circuit 252, provide a track enabling signal on line 254.

Controller 240-1 is designed to have a time constant TC3 while that of controller 240-2 is designed to have a time constant TC4, where TC4 is greater than TC3. Controller 240-2 therefore may be selected for control purposes in those situations where a relatively slow response time is required, such as in start-up operations whereas controller 240-1 with a relatively faster time constant will be utilized in situations where a quick response is required, such as in a quick load shed situation.

As opposed to the controller arrangement of FIG. 4, the controllers of FIG. 6 do not have identical inputs. Only one input is common to both controllers and that input is the actual throttle pressure signal on line 101 provided by pressure transducer 100. The other input to controller 240-2 is the desired throttle pressure set point on line 260 provided by a process independent set point generator 262. In order to prevent opening of the high pressure bypass system during normal turbine operation, the quick load shed controller 240-1 has as its second input on line 264, a signal indicative of the desired throttle pressure set point plus some bias value. One way of adding this bias value is with the provision of bias amplifier 268 which receives the desired throttle pressure set point signal on line 260 and adds to it some preselected bias B.

After initial firing, many boiler systems operate at a fixed throttle pressure independent of boiler load. For example in a fixed pressure system operable at a throttle pressure of 2400 pounds per square inch (p.s.i.) any change in load tending to vary this pressure results in more or less fuel being provided to the boiler so as to maintain a constant pressure as a function of load. With a fixed pressure system therefore the throttle pressure set point generator 262 may be any device or circuit which provides a constant output voltage indicative of the desired constant throttle pressure. In a rudimentary form this function may be provided by a simple potentiometer.

Other boiler arrangements instead of operating at a fixed throttle pressure operate in a sliding pressure mode wherein the throttle pressure varies between minimum and maximum values as a function of load, with this type of operation resulting in better fuel efficiency and more even turbine temperature. By way of example, a classical sliding pressure curve is illustrated in FIG. 7.

Figure 7:
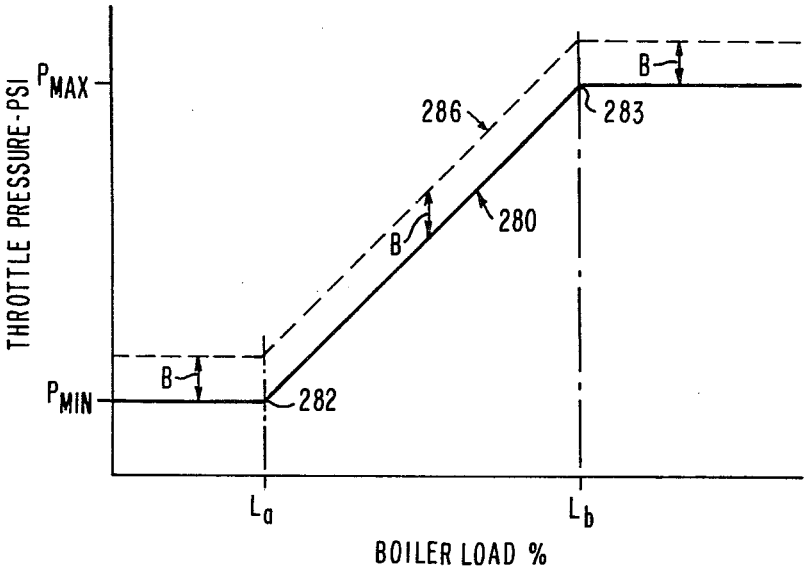
FIG. 7 illustrates a typical boiler load vs. throttle pressure characteristic curve for sliding pressure operation.
Figure 8:
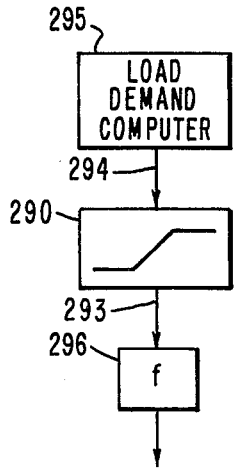
FIG. 8 is a block diagram illustrating the generation of a throttle pressure setpoint as a function of load.

Solid curve 280 in FIG. 7 represents the boiler throttle pressure profile with respect to boiler load with boiler load in percent being plotted on the horizontal axis while rated throttle pressure in p.s.i. is plotted on the vertical axis. The operation of the boiler is such that the throttle pressure is maintained at some minimum pressure up to a certain load $L_a$, at break point 282. Thereafter the pressure linearly increases with load up to break point 283, at load $L_b$. Thereafter the pressure is maintained constant at some maximum value. If some constant bias B is added to the boiler throttle pressure profile, a curve such as 286, shown dotted, results. The boiler profile, or characteristic curve is utilized in a well known manner to generate a throttle pressure set point. One way in which this is accomplished in various steam turbine generator power plants is basically illustrated in FIG. 8.

Circuit 290 is of the type which will provide, on line 293, an output signal indicative of the proper throttle pressure set point as a function of an input signal on line 294 indicative of load, and will provide the set point signal in accordance with the characteristic curve as illustrated for example in FIG. 7. The proper load signal in turn is provided by a load demand computer 295, although other control devices, such as the plant master, may alternatively supply this load signal.

A rate limiter circuit 296 is generally provided and can, during quick load change transients, decouple the throttle set point from its load index to allow the process to achieve quick load changes while still maintaining pressure changes within allowable limits.

The throttle pressure set point generator 262 accordingly, generates a desired throttle pressure set point in a sliding pressure mode of operation in accordance with the profile of FIG. 7, and which set point is a commanded set point completely independent of steam flow. The process independent set point generation may also be accomplished with other boiler modes of operation such as fixed pressure, time ramp or in an efficient valve position mode as described in U.S. Pat. No. 4,178,762 wherein the throttle pressure as a function of load profile varies in what appears to be a clipped sawtooth manner.

OPERATION OF PRESSURE CONTROL CIRCUIT 150

Let it be assumed that a hot restart operation is initiated which requires for example a 30% boiler load so as to attain a desired temperature to match the turbine. One way of performing this operation is to select a desired throttle pressure set point utilizing the characteristic curve of FIG. 7 for the given boiler load condition. Initially, the turbine steam admission valves as well as bypass valve 72 will be in a closed condition such that as the boiler is fired the throttle pressure, as measured by pressure transducer 100 will increase accordingly. As the actual throttle pressure signal on line 101 approaches the desired throttle pressure signal on line 260, controller 240-2, selected for control operation by an appropriate signal applied to terminal 248, will provide an output signal causing bypass valve 72 to open to a position whereby the desired and actual throttle pressures will be maintained in equilibrium and to pass the 30% of the boiler steam capacity into the bypass system.

If for some reason it is desired to change the throttle pressure set point, controller 240-2 will be operative to either further open or close the bypass valve 72 so as to vary the actual throttle pressure accordingly. Although controller 240-2, as well as controller 240-1, is similar to the controllers previously described, there is a slight difference in operation with respect to the limits imposed on the output signal. More particularly, input lines 101 and 260 of controller 240-2 have been given a positive (+) and negative (−) designation respectively. If the input signal on the positive line is greater than that on the negative line, controller 240-2 will provide a positive going output signal which is limited at some predetermined positive voltage. If the signal on the negative input line predominates over that on the positive input line the output signal of controller 240-2 will decrease in value to a lower limit of zero volts, that is, the output of controller 240-2 will not go negative. This same operation is also true of controller 240-1.

Accordingly, if the desired throttle pressure set point signal is decreased, controller 240-2 will provide an output signal tending to open the bypass valve 72 so as to decrease the actual throttle pressure whereas if the set point signal is increased, the output controller 240-2 will decrease (toward its zero voltage limit) tending to close the bypass valve and increase the actual throttle pressure.

At some point in the start-up process steam is to be admitted into the turbine to eventually bring it up to synchronous speed. One way of accomplishing this is to initially admit steam to the intermediate pressure turbine 13 by control of valve arrangement 36 such as described in copending application Ser. No. 397,260 filed July 12, 1982 and assigned to the same assignee as the present invention. After the turbine reaches a predetermined speed, control is switched to the steam admission valve arrangement 28. As the steam admission valves to the turbine are slowly opened, the actual throttle pressure will tend to decrease. Controller 240-2 however will sense the unbalance and provide an output signal tending to close bypass valve 72 so as to maintain the actual throttle pressure at the desired set point value. This process continues with more steam being admitted to the turbine and less to the bypass system until such time that bypass valve 72 closes and all of the boiler produced steam is provided to the turbine. The closure of bypass valve 72 may be sensed by a limit switch (not shown) and in response thereto throttle pressure control may be transferred to either the boiler or turbine control systems and an appropriate signal is applied to terminal 248 so as to prime controller 240-1 for control operation while placing controller 240-2 in a tracking mode.

Controller 240-1, it will be remembered, has the quicker time constant and accordingly can function to quickly open the bypass valve 72 upon the occurrence of any overpressure exceeding the predetermined constant bias B, which bias ensures that the bypass valve will not be opened prematurely during normal pressure variations.

Examining the inputs to controller 240-1, the signal on line 101 in an equilibrium situation at a particular load corresponds to the throttle pressure as represented by a particular point on solid curve 280 of FIG. 7 whereas the signal on line 264 corresponds to a particular point on the dotted curve 286. Although the signal on line 264 is greater than the signal on line 101 by a constant amount B, bypass valve 72 remains in a closed condition since the output of controller 240-1 is clamped at zero volts. As long as the normal excursions of the actual throttle pressure do not exceed the bias B, the bypass valve will remain closed. Conversely, if a pressure excursion, for example, caused by a load rejection, should exceed the predetermined bias controller 240-1 will quickly provide an output signal in response to the unbalance so as to cause bypass valve 72 to open up thereby allowing boiler steam to pass into the bypass system whereupon the throttle pressure is held at some set point plus bias value until normal operation may be restored. After a predetermined time delay control is again switched back to controller 240-2 so as to regulate the throttle pressure back down to a desired throttle pressure set point from a higher valued throttle pressure set point plus bias. The control transfer is bumpless since controller 240-2 had been tracking the output of controller 240-1 and accordingly was providing the same output signal just prior to the transfer. After correction of the problem and transfer of all the steam flow to the turbine, controller 240-1 is again enabled so as to assume its overpressure regulation function.

Figure 10:
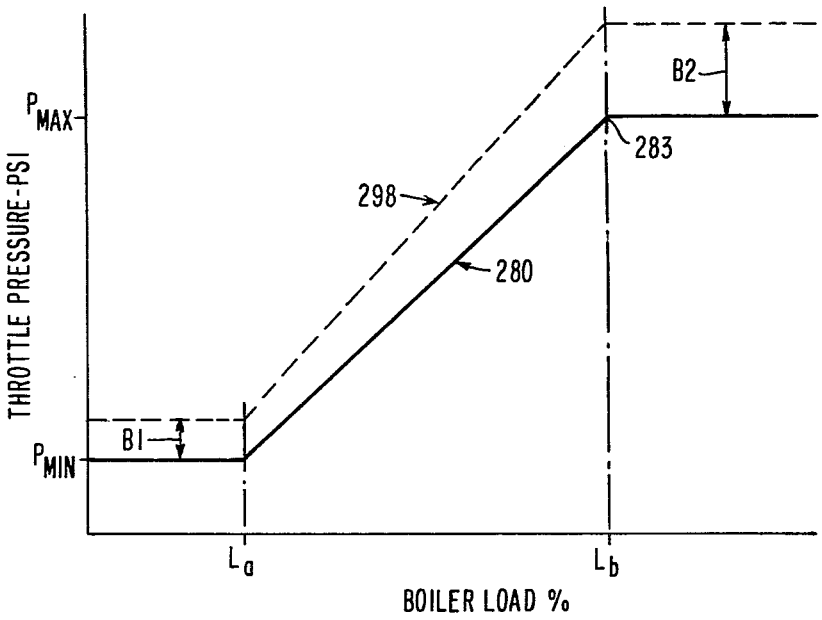
FIG. 10 is a curve as in FIG. 7 and illustrates the bias arrangement of FIG. 9.
Figure 9:
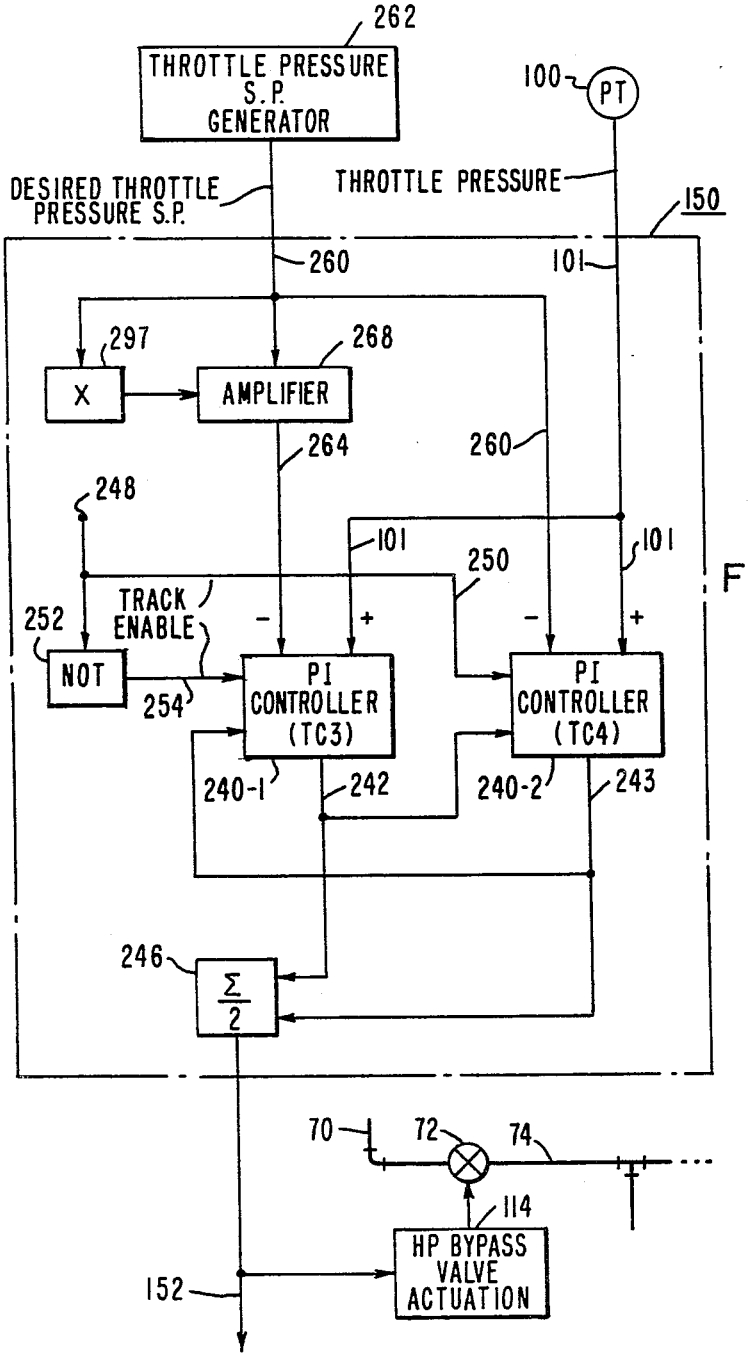
FIG. 9 is a block diagram illustrating an alternative bias arrangement to that shown in FIG. 6.

FIG. 9 illustrates an alternative arrangement for applying a bias to the desired throttle pressure set point signal. As opposed to having a fixed bias B applied to amplifier 268, the arrangement of FIG. 9 includes a multiplier circuit 297 which takes a certain predetermined percentage of the signal value on line 260 and applies it to amplifier 268. For example, a desired bias of 5% would require a multiplier circuit which would multiply the signal on line 260 by 0.05. For a sliding pressure operation the bias curve would be as described by the dotted curve 298 in FIG. 10 where it is seen that up to break point 282 a first bias B1 is established while past break point 283 a second and higher bias B2 is established. The bias relative to the sloping portion of the curve between break points 282 and 283 progressively increases from the minimum B1 to the maximum B2 value.

SINGLE CONTROLLER OPERATION

Figure 11:
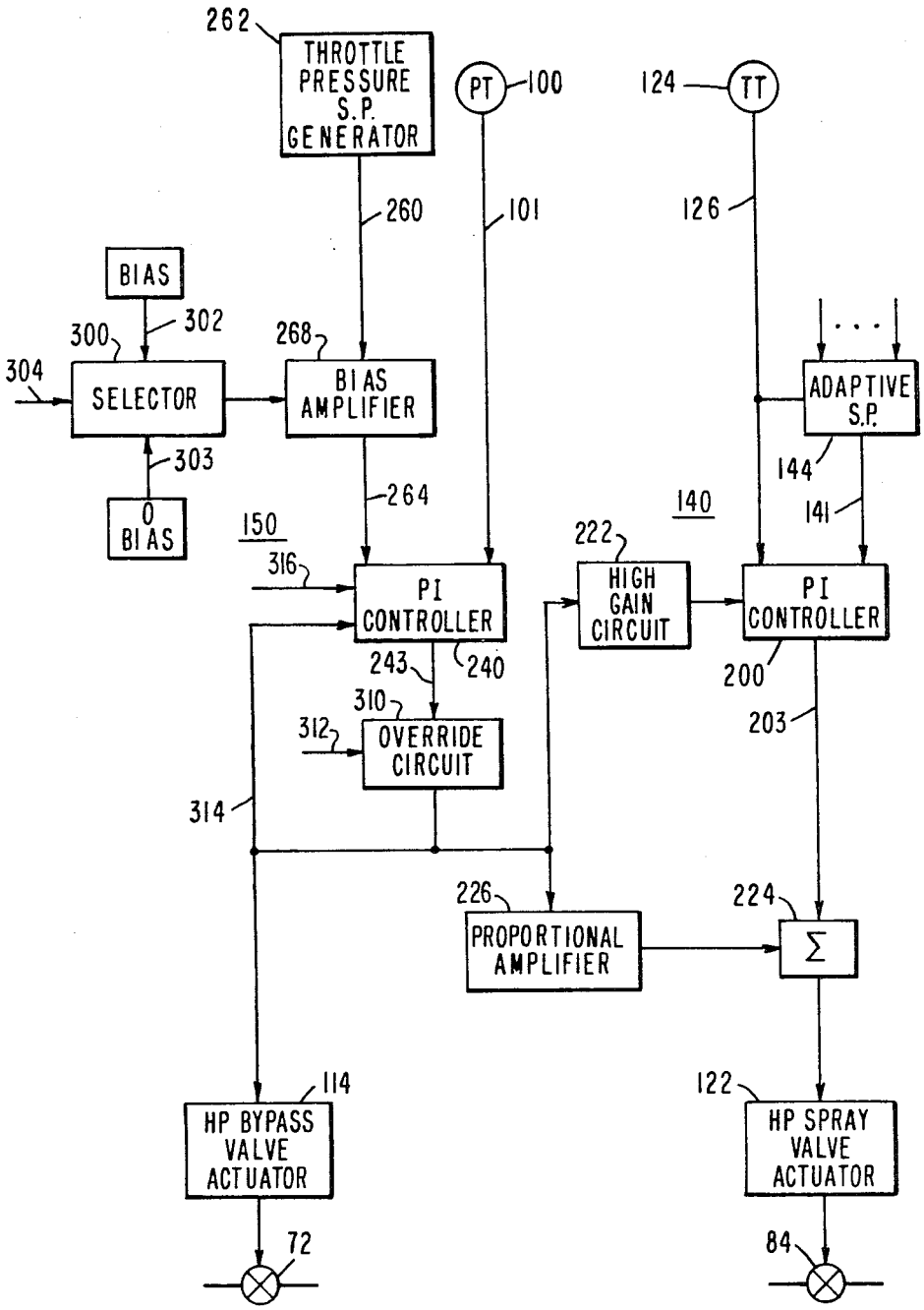
FIG. 11 is a block diagram illustrating another embodiment of the present invention.

In the apparatus thus far described, the pressure control circuit 150 and the spray valve control circuit 140 each included a dual controller arrangement, with one controller being utilized in slow response time situations and the other being used in fast response time situations. FIG. 11 illustrates an arrangement wherein single controllers may be utilized.

With respect to the pressure control circuit 150, a single proportional plus integral controller 240 is provided, with this controller having a relatively slow response time similar to controller 240-2 of FIG. 6. Controller 240 receives two input signals, one being the signal on line 101 indicative of actual throttle pressure and the other, a signal on line 264 being a function of the operating state of the turbine. More specifically, a selector circuit 300 is provided and is operable to pass either the bias signal B (or a percentage bias as in FIG. 9) on line 302 or a zero bias signal on line 303 depending upon a select signal applied on line 304. Thus, for example, during a start-up operation, the zero bias signal on line 303 is selected such that amplifier 268 passes the desired throttle pressure set point signal from generator 262 to constitute the other input, on line 264, to controller 240.

Conversely, when the turbine is fully operational and not on bypass operation, the bias on line 302 is selected such that amplifier 268 provides the set point plus bias signal to controller 240 and thus the pressure control circuit 150 operates in its overpressure control function as previously described. During this operation an event may occur, such as a turbine trip, which would require a rapid opening of the bypass system. In order to accommodate for those situations where a rapid response is required, a selector override circuit 310 is provided and is of the type which is normally operable to pass the output signal on line 243 from controller 240 except if an externally applied signal appears on line 312, in which case selector circuit 310 will provide a signal to command valve actuation circuit 114 to rapidly open bypass valve 72 to some predetermined maximum position. If the operating load is at some predetermined minimum value, then the signal applied on line 312 may be generated in response to a turbine trip, or the generator circuit breakers opening, by way of example.

The signal which activates the valve is fed back to controller 240 via line 314 as a signal to be tracked. When the fast valve actuation is initiated an appropriate signal is applied to input line 316 so as to place controller 240 into a tracking mode to replicate the valve actuation signal. When the valve is fully opened and the signal on line 312 is removed, the track enabling signal on line 316 is removed so as to provide for a bumpless transfer of control back to controller 240 which will then modulate the opening of bypass valve 72 in accordance with throttle pressure conditions.

With respect to the spray valve control circuit 140, a single proportional plus integral controller 200 is provided and is of the relatively slower response time variety such as controller 200-2 of FIG. 4. Controller 200 operates as did controller 200-2 during bypass operations and receives the same signals, the cold-reheat temperature on line 126 and the adaptive set point signal on line 141, as did controller 200-2. During non-bypass operations, spray valve 84 remains in a closed condition and will rapidly open to some predetermined maximum position upon the sudden occurrence of a bypass operation and will do so by virtue of the signal applied to line 312 of the selector override circuit 310. The resulting signal which commands the rapid opening of the bypass valve 72 is also applied to the proportional amplifier 226 which, in turn, provides a proportional signal through summation circuit 224 to valve actuation circuit 122 to cause the rapid opening of spray valve 84. Controller 200 will thereafter provide the necessary control signal for maintaining precise temperature control, as previously described.

The pressure control circuit 150 described in FIGS. 6, 9 or 11 therefore functions to govern the operation of the high pressure bypass valve during turbine start up so as to maintain the actual throttle pressure at a set point value, and further operates during normal turbine operation (non-bypass) as an overpressure regulator to quickly open the bypass system upon certain abnormal pressure conditions. The desired throttle pressure set point is generated completely independent of the steam flow process thereby eliminating the process feedback which would tend to objectionally vary the set point. In its dual capacity role (start up and normal turbine operation) the pressure control circuit is compatible with different pressure modes of operation such as fixed pressure, sliding pressure, modified sliding pressure, preprogrammed ramped throttle pressure, to name a few.

We claim:

1. High pressure temperature control apparatus for a steam turbine system having a steam generator, a high pressure turbine, at least one lower pressure turbine, a reheater in the steam flow path between said high and lower pressure turbines, and a steam bypass path for bypassing said turbines comprising:

(A) high pressure bypass valve means in said steam bypass path for controlling the introduction of steam into said bypass path;

(B) means for controlling said high pressure bypass valve means in response to predetermined pressure conditions of said system;

(C) means for measuring the temperature of the steam at the input and output of said reheater for providing respective cold and hot reheat temperature signals indicative thereof; and (D) means for regulating the temperature of the steam passed by said high pressure bypass valve means as a function of both said cold and hot reheat temperature signals.

2. High pressure temperature control apparatus for a steam turbine system having a steam generator, a high pressure turbine, at least one lower pressure turbine, a reheater in the steam flow path between said high and lower pressure turbines, and a steam bypass path for bypassing said turbines comprising:

(A) high pressure bypass valve means in said steam bypass path for controlling the introduction of steam into said bypass path;

(B) means for controlling said high pressure bypass valve means in response to predetermined pressure conditions of said system;

(C) means for measuring the temperature of the steam at the input and output and said reheater for providing respective cold and hot reheat temperature signals indicative thereof;

(D) a source of cooling fluid;

(E) high pressure spray valve means for admitting said cooling fluid into said steam bypass path; and (F) control means responsive to both said cold and hot reheat temperatures for governing operation of said high pressure spray valve means.

3. Apparatus according to claim 2 wherein said control means includes:

(A) an adaptive set point circuit responsive to said cold and hot reheat temperature signals for generating an adaptive set point signal; and (B) a spray valve control circuit responsive to said cold reheat temperature signal and said adaptive set point signal for providing an output signal for governing operation of said spray valve means.

4. Apparatus according to claim 3 which includes:

(A) means responsive to opening of said high pressure bypass valve means to initially open said spray valve means to some predetermined degree of opening.

5. Apparatus according to claim 4 which includes:

(A) means for providing a signal proportional to the opening of said high pressure bypass valve means; and (B) a summation circuit responsive to said latter signal and to said output signal of said spray valve control circuit for providing a summed output signal to govern said degree of opening.

6. Apparatus according to claim 2 wherein:

(A) said cooling fluid is admitted to said steam bypass path at a point downstream of said high pressure spray valve means and before said reheater.

7. Apparatus according to claim 3 wherein said adaptive set point circuit includes:

(A) controller means;

(B) memory means operable to store said hot reheat temperature signal upon initiation of steam bypass operation;

(C) said controller means being responsive to said cold reheat temperature signal to provide an output signal indicative thereof prior to said initiation of steam bypass operation, to constitute said adaptive set point;

(D) said controller means being responsive to the actual hot reheat temperature signal and said stored hot reheat temperature signal to provide an adaptive set point output signal, subsequent to said initiation of steam bypass operation.

8. Apparatus according to claim 7 which includes:

(A) means for modifying said stored hot reheat temperature signal applied to said controller means.

9. Apparatus according to claim 8 wherein said means for modifying includes:

(A) means for receiving at least one input signal indicative of a predetermined temperature value;

(B) means for obtaining a difference signal indicative of the difference between said input signal and said stored hot reheat temperature signal; and (C) means for adding said difference signal and said stored hot reheat temperature signal to provide said modified hot reheat temperature signal.

10. Apparatus according to claim 9 which includes:

(A) circuit means interposed between said means for obtaining a difference signal at said means for adding, to gradually ramp said difference signal prior to application to said means for adding.

11. Apparatus according to claim 10 wherein:

(A) said circuit means is operative to apply said gradually ramped difference signal only during steam bypass operation.

12. Apparatus according to claim 9 wherein:

(A) said means for receiving receives at least two input signals each indicative of a respective predetermined temperature value;

(B) said means for receiving being operable to provide only a selected one of said input signals to said means for obtaining a difference signal.

13. Apparatus according to claim 12 wherein:

(A) the lower valued one of said input signals is so provided.

14. Apparatus according to claim 3 wherein said spray valve control circuit includes:

(A) control means having a first response time to an unbalance in its input signals, when said turbine is in an operational mode, and a second and slower response time when said turbine is in a start-up mode.

15. Apparatus according to claim 14 wherein said control means includes:

(A) a first controller which receives said cold reheat temperature signal and said adaptive set point signal, and having said first response time; and (B) second controller which receives said cold reheat temperature signal and said adaptive set point signal, and having said first second time; and (C) means for selecting one of said controllers for control operation.

16. Apparatus according to claim 15 which includes:

(A) means for providing said controllers with an enabling signal only upon steam bypass operation.

17. Apparatus according to claim 15 wherein:

(A) each said controller is of the type which is operable in a first mode of operation to provide an output control signal in response to its input signals and operable in a second mode of operation to replicate an applied signal to be tracked.

18. Apparatus according to claim 15 which includes:

(A) means for providing the output signal of one controller as a signal to be tracked, to the other controller.

19. Apparatus according to claim 18 which includes:

(A) a summation circuit of the type which will provide an output signal which is half the sum of its input signals;

(B) the output signals of said controllers being applied as input signals to said summation circuit; and (C) said output signal of said summation circuit governing said operation of said spray valve means.

20. Apparatus according to claim 15 wherein:

(A) said controllers are proportional plus integral controllers.

21. A method of controlling the steam temperature in a steam turbine high pressure bypass system which includes a steam reheater, comprising the steps of:

(A) obtaining measurements of the input and output temperatures of said reheater; and (B) regulating the bypass steam temperature as a function of both said temperatures.

22. A method according to claim 21 including the step of:

(A) regulating said bypass steam temperature by controlled introduction of cooling liquid.

* * * * *